US010910713B1

(12) United States Patent
Kaddour et al.

(10) Patent No.: US 10,910,713 B1
(45) Date of Patent: Feb. 2, 2021

(54) RECONFIGURABLE ROTATIONAL REFLECTARRAYS

(71) Applicants: Abdul-Sattar Kaddour, Miami, FL (US); Stavros Georgakopoulos, Miami, FL (US)

(72) Inventors: Abdul-Sattar Kaddour, Miami, FL (US); Stavros Georgakopoulos, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/857,421

(22) Filed: Apr. 24, 2020

(51) Int. Cl.
*H01Q 3/46* (2006.01)
*H01Q 15/16* (2006.01)
*H01Q 15/00* (2006.01)

(52) U.S. Cl.
CPC ..... *H01Q 3/46* (2013.01); *H01Q 15/0006* (2013.01); *H01Q 15/165* (2013.01)

(58) Field of Classification Search
CPC ..... H01Q 3/46; H01Q 15/0006; H01Q 15/165–166
See application file for complete search history.

(56) References Cited

U.S. PATENT DOCUMENTS 7,492,322 B2 * 2/2009 Jung ..... H01Q 1/3275 343/757
2010/0097290 A1 * 4/2010 Legay ..... H01Q 3/20 343/880
2019/0056541 A1 * 2/2019 Roberts ..... G02B 5/136

* cited by examiner

*Primary Examiner* — Dimary S Lopez Cruz
*Assistant Examiner* — Amal Patel
(74) *Attorney, Agent, or Firm* — Saliwanchik, Lloyd & Eisenschenk

(57) ABSTRACT

A rotatable reflectarray antenna system and methods for reconfiguring electromagnetic (EM) characteristics of the reflectarray antenna are provided. The rotatable reflectarray antenna includes a plurality of rotatable reflecting units coupled with each other; and an actuator system coupled with the plurality of rotatable reflecting units and configured to rotate the reflecting units with respect to axes of the reflecting units. Each rotatable reflecting unit includes a substrate and a plurality of reflectarray patterns disposed on surfaces of the substrate and each reflectarray pattern includes a plurality of reflectarray elements. The actuator system is configured to rotate the plurality of reflecting units to different operational positions such that when layout of the plurality of reflectarray patterns on the plurality of reflecting unit is changed, at least one EM characteristic of the reflectarray antenna is reconfigured.

19 Claims, 4 Drawing Sheets

RECONFIGURABLE ROTATIONAL REFLECTARRAYS

GOVERNMENT SUPPORT

This invention was made with government support under Award Number FA9550-18-1-0191 awarded by the Air Force. The government has certain rights in the invention.

BACKGROUND

In the past decades, reflectarray antennas (RAs) as a new concept have been proposed for beam-steering applications due to their advantages over reflectors and phased arrays. To realize a steerable radiation pattern, the phase distribution $\phi(x_i,y_i)$ on the RA aperture needs to be tuned corresponding to the desired beam direction. The phase distribution for each element on the RA aperture instantly includes two components as shown in equation (1)

$$\phi(x_i,y_i)=-k_0R_i+\phi_R(x_i,y_i) \quad (1)$$

where $-k_0R_i$ and $\phi_R(x_i,y_i)$ are the phase delay and the progressive phase, respectively.

Different tuning approaches, such as, aperture phase tuning techniques and feed tuning are investigated for beam-scanning RAs. Phase tuning techniques typically can be implemented by different technologies, for example, micromotors, pin-diodes and RF-MEMS. Despite supporting higher speed beam control, phase tuning suffers from various limitations including design complexity, increased fabrication costs, and low efficiency caused by high loss. On the other hand, the feed tuning technique changes the phase of an RA aperture by tuning the spatial delay. For beam-scanning applications, the phase center of the feed antenna is required to be displaced in a specific path (e.g., lateral or circular arc path). However, these techniques require a complicated mechanical design and the aperture efficiency of the RA has a dependency on the feed position.

BRIEF SUMMARY

There continues to be a need in the art for improved designs and techniques for beam-scanning RAs. Embodiments of the subject invention pertain to using rotatable reflectarray reflecting surfaces of RA antennas for reconfiguring electromagnetic (EM) characteristics of the antennas.

In an embodiment of the invention, a reconfigurable reflectarray antenna can comprise: a plurality of rotatable reflecting units coupled with each other; an actuator system coupled with the plurality of rotatable reflecting units and configured to rotate the reflecting units with respect to axes of the reflecting units; each rotatable reflecting unit comprising: a substrate; a plurality of reflectarray patterns disposed on surfaces (e.g., upper or top surfaces, or on the upper or top surface) of the substrate, each reflectarray pattern comprising a plurality of reflectarray elements; and a ground plane disposed on a surface (e.g., a lower or bottom surface) of the substrate. The actuator system can be configured to rotate the plurality of reflecting units to different operational positions such that when layout of the plurality of reflectarray patterns on the plurality of reflecting unit is changed, at least one electromagnetic (EM) characteristic of the reflectarray antenna is reconfigured. In a predetermined operational position, an aperture of the reflectarray can be formed by (at least) two reflectarray patterns that are optimized to direct an illuminating beam in a new direction. The at least one EM characteristic can comprise one or more of beam direction, polarization, and frequency. Phase distributions of the plurality of reflectarray elements are optimized to achieve the desired EM characteristics at predetermined directions. The plurality of reflectarray patterns can have a fixed aperture size. The plurality of reflectarray elements can have, for example, a rectangular shape, a square shape, or a circular lattice shape. Moreover, the actuator system can be configured to individually rotate each reflecting unit or simultaneously rotate all the reflecting units and the actuator system is configured to rotate the reflecting units in a clockwise direction or in a counterclockwise direction. The plurality of rotatable reflecting units can comprise three rotatable reflecting units each formed with a triangular prism structure. When three lateral reflecting surfaces of the three adjacent rotatable reflectarray units are horizontally aligned with each other, one reflectarray reflecting panel having one of a variety of reflectarray patterns can be formed to reflect the incident waves fronts. The three rotatable reflecting units formed with a triangular prism structures can be simultaneously rotated by a rotation angle of, for example, 0°, 120°, or 240°. Further, the actuator can comprise a step motor. The layout of the plurality of reflectarray patterns can be rotated into different operational positions to provide different directions of illuminating beams. Only one reflectarray pattern of the plurality of reflectarray patterns can be exposed to be illuminated for each operational position. The substrate can be made of a flexible or rigid material, and the substrate material can be, for example, Duroid, FR-4, or Kapton. The surfaces of the substrate on which the plurality of reflectarray patterns is disposed can be flat or curved reflecting surfaces. The plurality of reflectarray elements can be made of a metal, for example, copper, aluminum, silver, gold, platinum, of an alloy of one or more those metals.

DETAILED DESCRIPTION

Embodiments of the subject invention provide novel and advantageous reflectarray (RA) antennas including rotatable and reconfigurable reflectarray reflecting structures for reconfiguring electromagnetic (EM) characteristics of the RA antennas.

Figure 1:
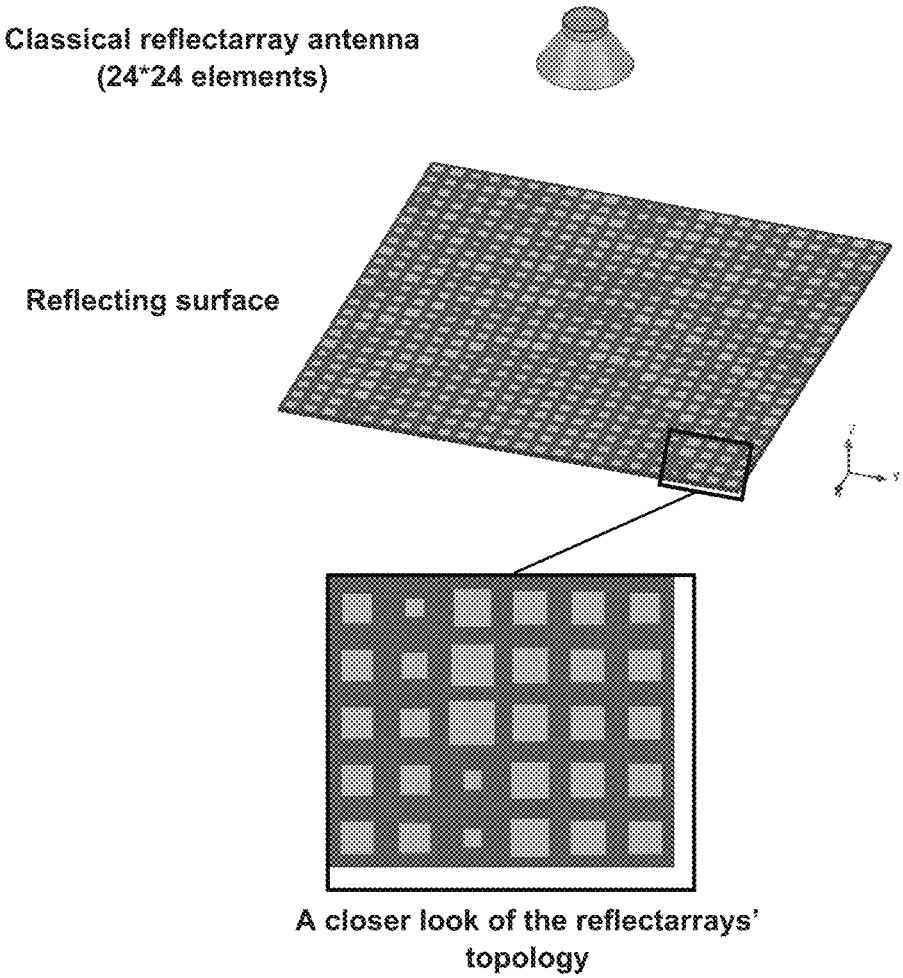
FIG. 1 is a schematic representation of a classical reflectarray antenna.

Referring to FIG. 1, a reflectarray is an antenna comprising a feed transmitting waves/beams onto a reflecting structure that have an array of reflecting elements arranged on reflecting surfaces of the reflecting structure such that the waves/beams reflected from the individual reflecting elements combine to produce a prescribed secondary radiation pattern.

The reflecting structure of the RA antenna can comprise a substrate having either a flat or a slightly curved reflecting surface and an array of reflecting elements disposed on the reflecting surface to form a variety of reflectarray patterns. The feed of the RA antenna spatially transmits waves/beams to illuminate the reflectarray patterns that are designed to reradiate and scatter the incident field with electrical phases required to form a planar phase front in the far-field distance.

To generate the planar phase front, the reflectarray elements can be formed of a plurality of unit cells ("patches") having variable sizes such that the reflectarray elements have different scattering impedances, resulting in different phases to compensate for different feed-path delays.

Figure 2:
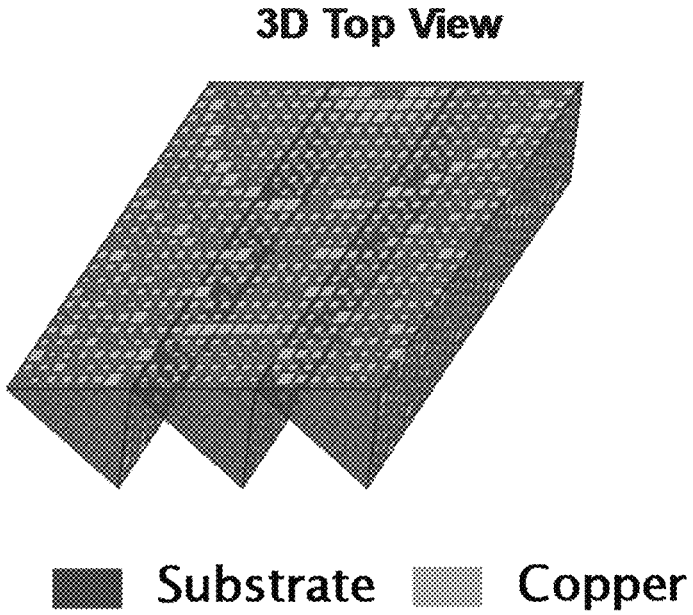
FIG. 2 shows a perspective view of a reflecting structure of the reflectarray antenna, according to an embodiment of the subject invention.

FIG. 2 shows a rotatable and reconfigurable reflecting structure of the reflectarray antenna according to an embodiment of the subject invention. The rotatable and reconfigurable reflecting structure can comprise a plurality of, for example, three, rotatable reflectarray units coupled with each other. Each rotatable reflectarray unit is formed with a substrate of a triangular prism structure having three lateral surfaces each having a rectangular shape and two end surfaces each having a triangular shape. Each of the three lateral surfaces has a plurality of reflecting elements disposed thereon, capable of reflecting waves/beams transmitted from the feed of the RA antenna. It is noted that the number of the plurality of rotatable reflectarray units is not limited to three and thus the reflecting structure of the reflectarray antenna can comprise any suitable number of rotatable reflectarray units.

In one embodiment, when the three lateral reflecting surfaces of the three adjacent rotatable reflectarray units are horizontally aligned with each other, one reflectarray reflecting panel having one of a variety of reflectarray patterns is formed as shown in FIG. 2.

In one embodiment, the plurality of reflectarray elements is formed of 25×25 square unit cells ("patches") printed on any one of the lateral reflecting surfaces of the rotatable reflectarray units.

In one embodiment, the substrates can be made of a flexible or rigid material. For example, the substrates can be made of Duroid, FR4, or Kapton.

In one embodiment, the plurality of reflectarray elements disposed on the substrates can be made of a metal or an alloy of metals. For example, the plurality of reflectarray elements can be made of copper or an alloy of copper.

The reflectarray (RA) antenna further comprises an actuator system coupled with the reflecting structure and configured to rotate the plurality of reflectarray panels of the reflecting structure to different operational positions such that when the layout of the plurality of reflectarray elements disposed on the rotatable reflectarray panels is changed, at least one electromagnetic (EM) characteristic of the reflectarray antenna is reconfigured.

In one embodiment, when the actuator system is configured to rotate the plurality of reflectarray panels to a predetermined operational position, directions of illuminating waves/beams from the feed are reconfigured.

Figure 3:
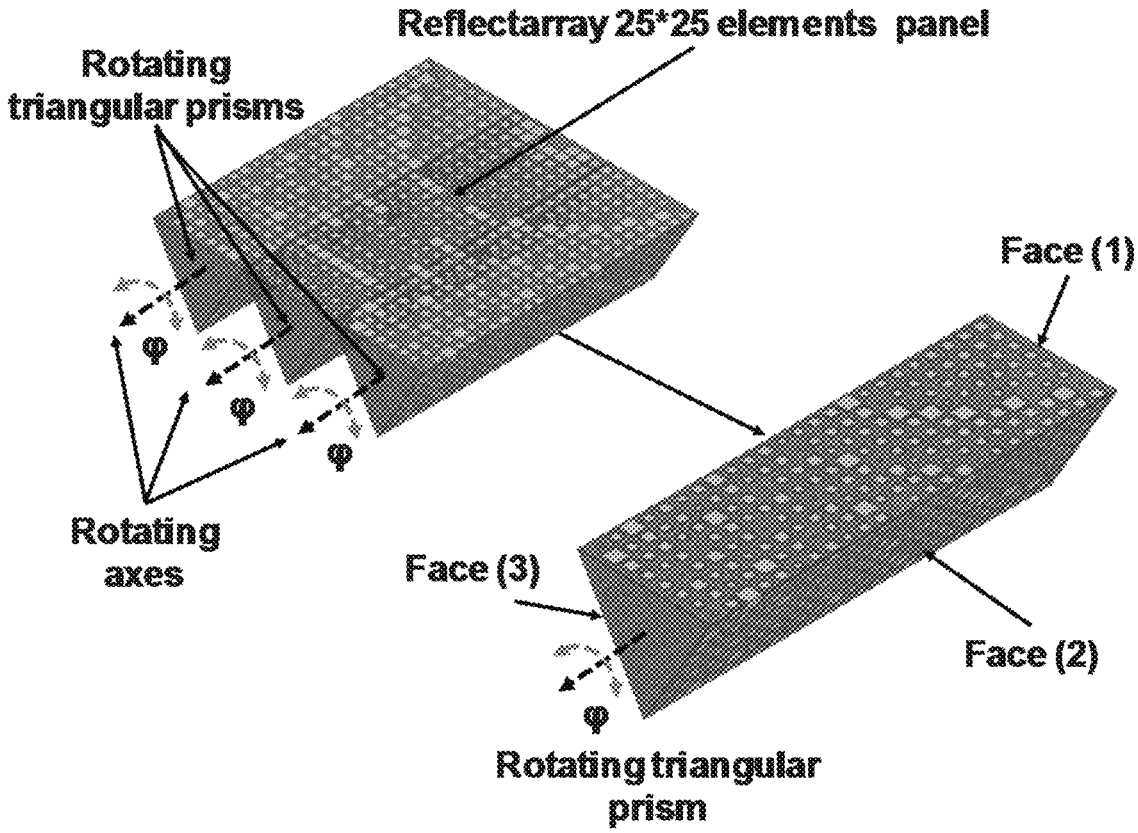
FIG. 3 is a schematic representation of a rotatable and reconfigurable reflectarray reflecting structure that can reconfigure its beam direction by rotating a portion or a pattern of the reflectarray reflecting structure to an operational position to be illuminated by the feed of the reflectarray antenna, according to an embodiment of the subject invention.

As illustrated in FIG. 3, each of the three rotatable reflectarray units formed with the triangular prism structures has a rotation axis around which the corresponding reflectarray unit can be rotated manually by a user or automatically by the actuator system.

In one embodiment, each reflectarray unit of the plurality of reflectarray units can be individually rotated by any rotation angle either in a clockwise direction or in a counterclockwise direction with respect to the corresponding axis such that a horizontal reflectarray panel is formed by the adjacent reflecting surfaces of the plurality of reflectarray units.

In one embodiment, all reflectarray units of the plurality of reflectarray units can be simultaneously rotated by any rotation angle with respect to the corresponding axes such that a horizontal reflectarray panel is formed by the adjacent reflecting surfaces of the plurality of reflectarray units.

Thus, unlike a conventional reflectarray antenna that has only one static operation mode and only one reflecting panel, the reflectarray antenna having the rotatable and reconfigurable reflecting structure, when the reflecting structure is rotated to different operational positions, can be configured to form a plurality of different reflectarrays panels to reflect the incident waves/beams from the feed.

In one embodiment, the actuator system performing the rotations of the rotatable reflectarray units can include, but not limited to, robotics or motors such as a step motor.

Figure 4A:
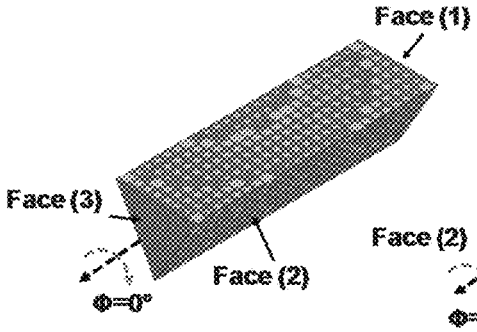
FIGS. 4(*a*)-(*c*) are schematic representations of the rotatable and reconfigurable reflectarray reflecting structure being rotated to an operational position to be illuminated by the feed of the reflectarray antenna, (a) a triangular prism of the reflectarray reflecting structure being rotated by φ=0°, (b) the triangular prism of the reflectarray reflecting structure being rotated by φ=120°, and (c) the triangular prism of the reflectarray reflecting structure by φ=240°, according to an embodiment of the subject invention.
Figure 4B:
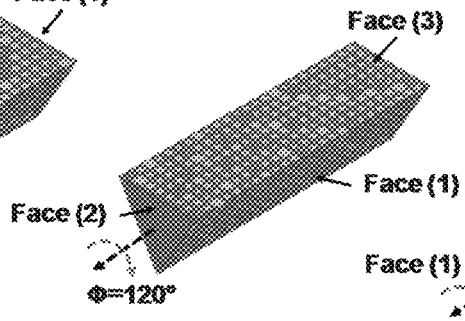
Figure 4C:
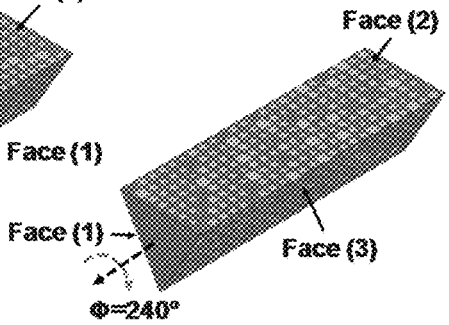

Referring to FIG. 4(*a*)-(*c*), one rotatable reflectarray unit is rotated to an operational position to be illuminated by the feed of the reflectarray antenna.

As shown in FIG. 4(*a*), the rotatable reflectarray unit having a triangular prism structure is placed in an initial operational position without any rotation (rotation angle $\phi=0°$) with respect to the axis of the reflectarray unit. As a result, a first reflecting surface ("face 1") is placed as a top surface of the reflectarray unit, while a second reflecting surface ("face 2") is placed as a right side surface of the reflectarray unit and a third reflecting surface ("face 3") is placed as a left side surface of the reflectarray unit.

Moreover, as shown in FIG. 4(*b*), the rotatable reflectarray unit having a triangular prism structure is rotated in a clockwise direction by a rotation angle $\varphi=1200$ with respect to the axis of the reflectarray unit. As a result, the first reflecting surface ("face 1") is rotated to be the right side surface of the reflectarray unit, while the second reflecting surface ("face 2") is rotated to be a left side surface of the reflectarray unit and the third reflecting surface ("face 3") is rotated to be a top surface of the reflectarray unit.

Further, as shown in FIG. 4(*c*), the rotatable reflectarray unit having a triangular prism structure is rotated in a clockwise direction by a rotation angle $\phi=240°$ with respect to the axis of the reflectarray unit. As a result, the first reflecting surface ("face 1") is rotated to be the left side surface of the reflectarray unit, while the second reflecting surface ("face 2") is rotated to be the top surface of the reflectarray unit and the third reflecting surface ("face 3") is rotated to be a right side surface of the reflectarray unit.

In one embodiment, each reflectarray panel formed by the adjacent reflecting surfaces is pre-optimized to obtain a different operating mode for beam direction, frequency, or polarization.

In one embodiment, the electromagnetic reconfigurability such as beamsteering reconfigurability, polarization reconfigurability, or frequency reconfigurability of the rotatable RA antenna can be obtained by rotating the reflectarray reflecting panels of the reflecting structure with respect to corresponding axes to change the electromagnetic layout, resulting in enhanced performance with low losses and low costs compared to conventional reconfigurable reflectarrays.

In one embodiment, each rotatable reflectarray unit is formed with a substrate of a double faced thin rectangular plate structure having rotatable surfaces having a plurality of reflecting elements disposed thereon, capable of reflecting waves/beams transmitted from the feed of the RA antenna. When a predetermined plurality of reflecting surfaces of the adjacent rotatable reflectarray units having the double faced thin rectangular plate structures are horizontally aligned with each other, one reflectarray reflecting panel having one of the variety of reflectarray patterns is formed.

In one embodiment, the reflectarrays elements can have different shapes such as a rectangular shape, a square shape, or a circular lattice shape.

In one embodiment, the number of rotation steps of the reflecting structure can be automatically or manually adjusted depending on the desired steering direction.

When the reflectarray reflecting surface is rotated by a specific number of rotation steps, the aperture of the reflectarray is formed by two new reflectarrays patterns that are optimized to direct the beam in a new direction.

The reflectarray reflecting surface is formed with a plurality of reflectarray elements and the number of the reflectarray elements depends on the number of desired operation states.

For each operation state, only one reflectarray panel can be illuminated. The reflectarray reflecting panels can be rotated in different directions, for example, in a clockwise direction or in a counter-clockwise direction. A new reflectarray panel is exposed to be illuminated in each different operation state.

Figure 5A:
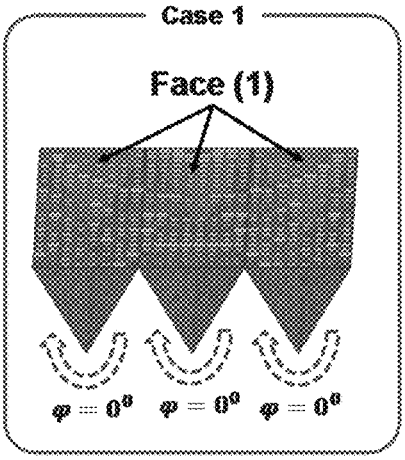
FIGS. 5(*a*)-(*c*) are schematic representations of the rotatable and reconfigurable reflectarray reflecting structure having three triangular prisms being rotated to three different operational positions to be illuminated by the feed of the reflectarray antenna, (a) the reflectarray reflecting structure being rotated by φ=0°, (b) the reflectarray reflecting structure being rotated by φ=120°, and (c) the reflectarray reflecting structure being rotated by φ=240°, according to an embodiment of the subject invention.
Figure 5B:
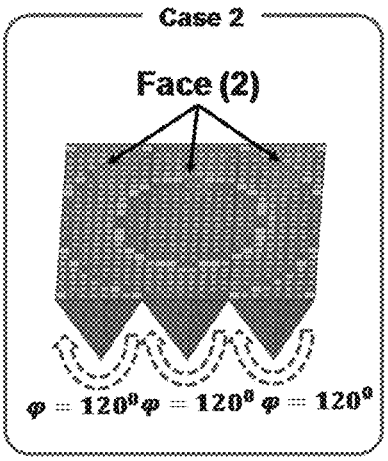
Figure 5C:
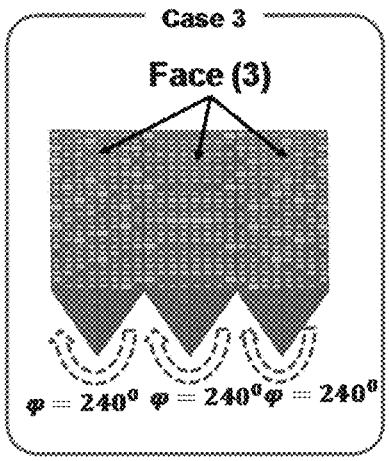

Referring to FIGS. 5(*a*)-(*c*), the rotatable and reconfigurable reflectarray reflecting structure having triangular prism is rotated to different operational positions to be illuminated by the feed of the reflectarray antenna. In particular, FIG. 5(*a*) shows that in a first case ("case 1"), the reflectarray reflecting structure is rotated by $\varphi=0°$. FIG. 5(*b*) shows that in a second case ("case 2"), the reflectarray reflecting structure is rotated by $\varphi=120°$. FIG. 5(*c*) shows that in a third case ("case 3"), the reflectarray reflecting structure is rotated by $\varphi=240°$. In each case, a different reflectarray reflecting panel having a different reflecting pattern is generated, resulting in different electromagnetic (EM) characteristics of the RA antenna.

Figure 6:
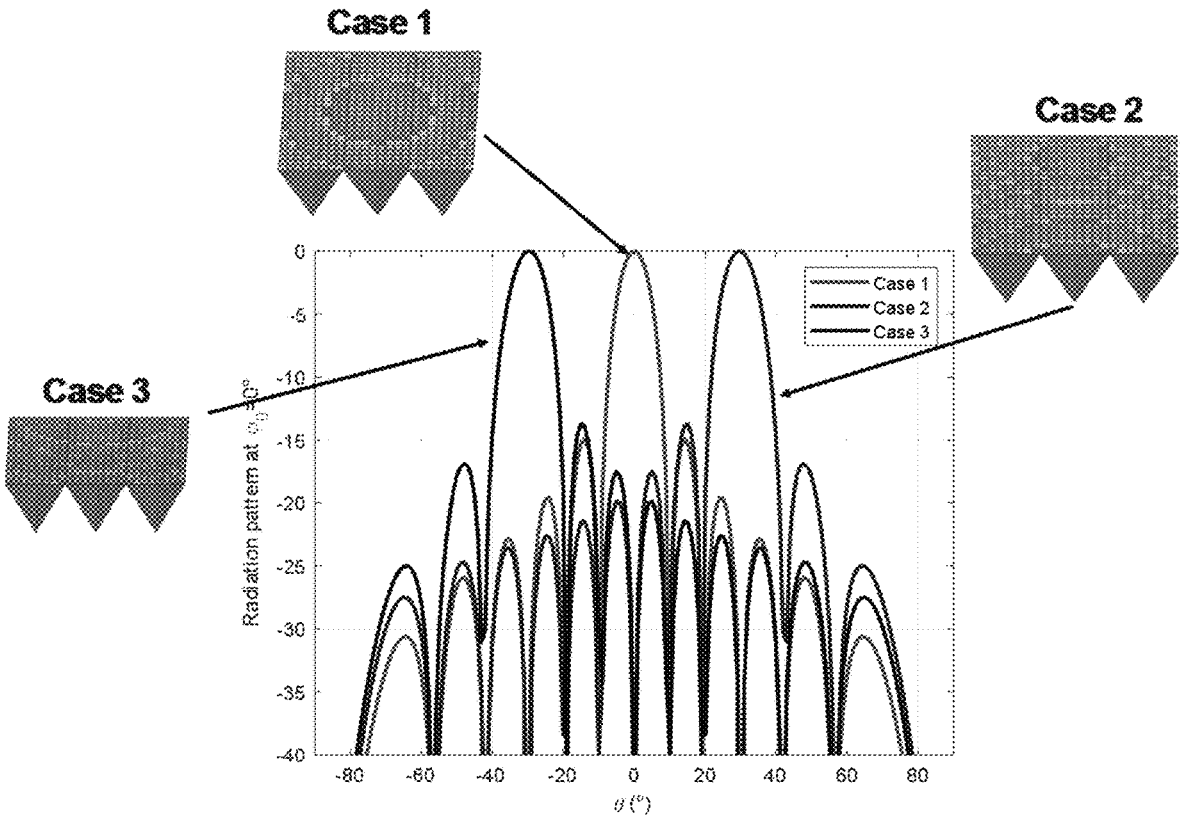
FIG. 6 is a diagram showing results of performance of the rotatable reflectarray antenna reflecting structure, showing scanned radiation patterns when being rotated to various operational positions, according to an embodiment of the subject invention.

The performance testing results of the rotatable and reconfigurable reflectarray antenna are illustrated by the diagram of FIG. 6. In particular, FIG. 6 shows scanned radiation patterns when the reflectarray patterns are formed for the three case of FIG. 5(*a*)-(*c*). It is observed from the figure that the steering angles may range from about −80° to about +80° in elevation angles. The results suggest that the rotatable and reconfigurable reflectarray of the subject invention is suitable for implementing high gain antennas with beam-steering capabilities that require low power.

The reflectarray can achieve broad beamsteering while maintaining the same aperture efficiency, utilizing a simple rotating mechanism and optimally designed sub-reflectarrays, which form the reflectarray aperture for each position of rotation that corresponds to a new beam direction.

The rotatable reflectarray can reconfigure the electromagnetic (EM) characteristics and can be efficiently packed. The ability of these structures to change their layouts or patterns of the reflecting surface gives an additional degree of freedom for multi-functionality, such that the user can direct the beam in the desired direction not relying only on the electronic configuration that is conventionally used. The rotatable and reconfigurable reflectarrays achieves EM reconfigurability by a rotation of the reflecting panels of the structure and can be efficiently stowed to occupy a small volume, making it ideal for applications such as space communication systems, multi-functional communication system, deployable and collapsible arrays, and small satellites (SmallSats) or satellites of low mass and size, where beamsteering with low power and high efficiency is highly desirable.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A reconfigurable reflectarray antenna, comprising:

a plurality of rotatable reflecting units coupled with each other; and an actuator system coupled with the plurality of rotatable reflecting units and configured to rotate the reflecting units with respect to axes of the reflecting units, each rotatable reflecting unit comprising:

a substrate;

a plurality of reflectarray patterns disposed on upper surfaces of the substrate, each reflectarray pattern comprising a plurality of reflectarray elements; and a ground plane disposed on a bottom surface of the substrate, the actuator system being configured to rotate the plurality of reflecting units to different operational positions such that when layout of the plurality of reflectarray patterns on the plurality of reflecting unit is changed, at least one electromagnetic (EM) characteristic of the reflectarray antenna is reconfigured, the plurality of rotatable reflecting units comprising three rotatable reflecting units, the three rotatable reflecting units comprising:

a first rotatable reflecting unit formed with a triangular prism structure comprising a first lateral surface, a second lateral surface, a third lateral surface, a first end surface, and a second end surface, each of the first lateral surface, the second lateral surface, the third lateral surface having a rectangular shape, and each of the first end surface and the second end surface having a triangular shape;

a second rotatable reflecting unit formed with a triangular prism structure comprising a first lateral surface, a second lateral surface, a third lateral surface, a first end surface, and a second end surface, each of the first lateral surface, the second lateral surface, the third lateral surface having a rectangular shape, and each of the first end surface and the second end surface having a triangular shape; and a third rotatable reflecting unit formed with a triangular prism structure comprising a first lateral surface, a second lateral surface, a third lateral surface, a first end surface, and a second end surface, each of the first lateral surface, the second lateral surface, the third lateral surface having a rectangular shape, and each of the first end surface and the second end surface having a triangular shape, and the operational positions of the plurality of reflecting units comprising a first position in which the first lateral surface of the first rotatable reflecting unit, the first lateral surface of the second rotatable reflecting unit, and the first lateral surface of the third rotatable reflecting unit are all aligned with each other in a same plane.

2. The reconfigurable reflectarray antenna according to claim 1, configured such that in a predetermined operational position, an aperture of the reflectarray is formed by at least two reflectarray patterns that are optimized to direct an illuminating beam in a new direction.

3. The reconfigurable reflectarray antenna according to claim 1, the at least one EM characteristic comprising one or more of beamsteering, polarization, and frequency.

4. The reconfigurable reflectarray antenna according to claim 1, phase distributions of the plurality of reflectarray elements being optimized to steer illuminating beams at predetermined directions.

5. The reconfigurable reflectarray antenna according to claim 1, the plurality of reflectarray patterns having a fixed aperture size.

6. The reconfigurable reflectarray antenna according to claim 1, the plurality of reflectarray elements having a rectangular shape, a square shape, or a circular lattice shape.

7. The reconfigurable reflectarray antenna according to claim 1, the actuator system being configured to individually rotate each reflecting unit or simultaneously rotate all the reflecting units.

8. The reconfigurable reflectarray antenna according to claim 1, the actuator system being configured to rotate the reflecting units in a clockwise direction or in a counterclockwise direction.

9. The reconfigurable reflectarray antenna according to claim 1, the reconfigurable reflectarray antenna being configured such that, in the first position, one reflectarray reflecting panel having one of a variety of reflectarray patterns is formed to reflect incident waves/beams.

10. The reconfigurable reflectarray antenna according to claim 1, the three rotatable reflecting units being configured to simultaneously rotate by a rotation angle of 0°, 120°, or 240°.

11. The reconfigurable reflectarray antenna according to claim 10, the actuator comprising a step motor.

12. The reconfigurable reflectarray antenna according to claim 1, the layout of the plurality of reflectarray patterns being rotated into different operational positions to provide different directions of illuminating beams.

13. The reconfigurable reflectarray antenna according to claim 1, configured such that only one reflectarray pattern of the plurality of reflectarray patterns is exposed to be illuminated for each operational position.

14. The reconfigurable reflectarray antenna according to claim 1, the substrate being made of a flexible material.

15. The reconfigurable reflectarray antenna according to claim 1, the substrate being made of a rigid material.

16. The reconfigurable reflectarray antenna according to claim 1, the surfaces of the substrate on which the plurality of reflectarray patterns is disposed being flat or curved reflecting surfaces.

17. The reconfigurable reflectarray antenna according to claim 1, the plurality of reflectarray elements being made of a metal.

18. The reconfigurable reflectarray antenna according to claim 17, the metal being copper or an alloy of copper.

19. A reconfigurable reflectarray antenna, comprising:

a plurality of rotatable reflecting units coupled with each other; and an actuator system coupled with the plurality of rotatable reflecting units and configured to rotate the reflecting units with respect to axes of the reflecting units, each rotatable reflecting unit comprising:

a substrate;

a plurality of reflectarray patterns disposed on surfaces of the substrate, each reflectarray pattern comprising a plurality of reflectarray elements; and a ground plane disposed on a bottom surface of the substrate, the actuator system being configured to rotate the plurality of reflecting units to different operational positions such that when layout of the plurality of reflectarray patterns on the plurality of reflecting unit is changed, at least one electromagnetic (EM) characteristic of the reflectarray antenna is reconfigured, the reconfigurable reflectarray antenna configured such that in a predetermined operational position, an aperture of the reflectarray being formed by at least two reflectarray patterns that are optimized to direct an illuminating beam in a new direction, the at least one EM characteristic comprising one or more of beamsteering, polarization, and frequency, phase distributions of the plurality of reflectarray elements being optimized to steer illuminating beams at predetermined directions, the plurality of reflectarray patterns having a fixed aperture size, the plurality of reflectarray elements having a rectangular shape, a square shape, or a circular lattice shape, the actuator system being configured to individually rotate each reflecting unit or simultaneously rotate all the reflecting units, the actuator system being configured to rotate the reflecting units in a clockwise direction or in a counterclockwise direction, the plurality of rotatable reflecting units comprising three rotatable reflecting units each formed with a triangular prism structure, when three lateral reflecting surfaces of the three adjacent rotatable reflectarray units being horizontally aligned with each other, one reflectarray reflecting panel having one of a variety of reflectarray patterns being formed to reflect incident waves/beams, the three rotatable reflecting units being formed with triangular prism structures being simultaneously rotated by a rotation angle of 0°, 120°, or 240°, the actuator comprising a step motor, the layout of the plurality of reflectarray patterns being rotated into different operational positions to provide different directions of illuminating beams, the reconfigurable reflectarray antenna configured such that only one reflectarray pattern of the plurality of reflectarray patterns being exposed to be illuminated for each operational position, the surfaces of the substrate on which the plurality of reflectarray patterns is disposed being flat or curved reflecting surfaces, and the plurality of reflectarray elements being made of a metal.

* * * * *